US007134971B2

(12) United States Patent
Franklin et al.

(10) Patent No.: US 7,134,971 B2
(45) Date of Patent: Nov. 14, 2006

(54) GOLF CLUB HEAD

(75) Inventors: David N. Franklin, Granbury, TX (US); John T. Stites, Weatherford, TX (US); Gary G. Tavares, Azle, TX (US); Carl L. Madore, Portland, OR (US)

(73) Assignee: Nike, Inc., Beaverton, OR (US)

( * ) Notice: Subject to any disclaimer, the term of this patent is extended or adjusted under 35 U.S.C. 154(b) by 52 days.

(21) Appl. No.: 10/774,696

(22) Filed: Feb. 10, 2004

(65) Prior Publication Data

US 2004/0180730 A1 Sep. 16, 2004

(51) Int. Cl.
*A63B 53/04* (2006.01)
*A63B 53/06* (2006.01)

(52) U.S. Cl. ..... 473/340; 473/332; 473/350

(58) Field of Classification Search ..... 473/324–350
See application file for complete search history.

(56) References Cited

U.S. PATENT DOCUMENTS

| | | | | | |
|---|---|---|---|---|---|
| 595,494 | A | * | 12/1897 | O'Meara | 266/262 |
| 3,084,940 | A | * | 4/1963 | Cissel | 473/332 |
| 3,970,236 | A | * | 7/1976 | Rogers | 228/196 |
| 4,027,885 | A | * | 6/1977 | Rogers | 473/342 |
| 5,524,331 | A | | 6/1996 | Pond | |
| 5,692,972 | A | | 12/1997 | Langslet | |
| 5,921,871 | A | | 7/1999 | Fisher | |
| 6,042,486 | A | | 3/2000 | Gallagher | |
| 6,159,109 | A | * | 12/2000 | Langslet | 473/332 |
| 6,425,831 | B1 | | 7/2002 | Heene et al. | |
| 6,431,997 | B1 | | 8/2002 | Rohrer | |
| 6,478,694 | B1 | | 11/2002 | Anderson et al. | |
| 6,638,183 | B1 | * | 10/2003 | Takeda | 473/335 |
| 2003/0022730 | A1 | | 1/2003 | Nelson et al. | |
| 2003/0073510 | A1 | | 4/2003 | Nelson et al. | |
| 2003/0119600 | A1 | | 6/2003 | Nelson | |
| 2003/0119601 | A1 | | 6/2003 | Nelson et al. | |
| 2003/0220156 | A1 | | 11/2003 | Solheim | |

FOREIGN PATENT DOCUMENTS

| | | |
|---|---|---|
| JP | 2001-129136 | 5/2001 |
| JP | 2001-276286 | 10/2001 |
| JP | 2002-224253 | 8/2002 |

* cited by examiner

*Primary Examiner*—Eugene Kim
*Assistant Examiner*—Alvin A. Hunter, Jr.
(74) *Attorney, Agent, or Firm*—Banner & Witcoff, Ltd.

(57) ABSTRACT

A golf club head is disclosed that includes a primary element and an insert element formed of different materials. The insert element is located within a cavity formed by the primary element. The cavity is defined by a portion of the primary element that is of unitary construction, and the cavity is positioned between a face and a rear surface of the head. At least a portion of the cavity extends in a direction that is substantially parallel to the first surface. Another aspect of the invention involves a method of manufacturing the golf club head that includes forming the primary element. The cavity is then defined within a portion of the primary element that is of unitary construction, and the insert element is positioned within the cavity.

13 Claims, 10 Drawing Sheets

GOLF CLUB HEAD

BACKGROUND OF THE INVENTION

1. Field of the Invention

The present invention relates to equipment for the game of golf. The invention concerns, more particularly, a golf club having a head that includes an insert.

2. Description of Background Art

A golf club has two primary elements, a shaft and a head. The shaft is a thin, elongate structure that is conventionally formed from graphite or steel materials, for example. A first end of the shaft may include a textured rubber coating to provide an area for an individual to securely grasp the golf club, and an opposite second end of the shaft is fastened to the head, which includes a substantially planar contact surface for engaging a golf ball. In use, the individual will grasp the first end of the shaft and swing the golf club such that the head contacts the golf ball and propels the golf ball in an intended direction and toward an intended target, such as a hole.

Commonly utilized types of golf clubs include drivers, woods, irons, and putters. Whereas the drivers, woods, and irons are generally utilized to propel the golf ball through the air, putters are utilized to induce the golf ball to roll across the ground (i.e., a green). As with other types of golf clubs, putters include a head that has a substantially planar contact surface for engaging a golf ball and propelling the golf ball in an intended direction.

The structure of a golf club may have an effect upon the direction traveled by the golf ball. For example, one factor that has an effect upon whether the golf ball is propelled in the intended direction relates to a position of a center of gravity of the golf club head. When the center of gravity is positioned behind the point of engagement on the contact surface, the golf ball follows a generally straight route. In circumstances where the center of gravity is spaced to a side of the point of engagement, however, the golf ball may follow a route that veers left or right. Another factor that has an effect upon whether the golf ball is propelled in the intended direction relates to a moment of inertia of the golf club head. When the moment of inertia is relatively large, the golf club head resists rotating upon contact with the golf ball and the golf ball follows a generally straight route. In circumstances where the golf club head rotates, however, the golf ball may follow a route that veers left or right. Manufacturers of golf equipment attempt, therefore, to configure putters and other golf clubs such that the center of gravity is spaced from the face of the golf club and the moment of inertia is relatively large, thereby increasing the accuracy of the golf club.

SUMMARY OF THE INVENTION

The present invention is a golf club having a shaft and a head secured to the shaft. The head includes a primary element formed of a first material, a cavity, and an insert element formed of a different second material. The primary element defines a first surface and an opposite second surface, with the first surface providing an area for engaging a golf ball. The cavity is defined by a portion of the primary element that is of unitary construction, and the cavity is positioned between the first surface and the second surface. At least a portion of the cavity extends in a direction that is substantially parallel to the first surface. The insert element is positioned within the cavity.

Another aspect of the invention involves a method of manufacturing a head for a golf club. The method includes a step of forming a primary element of the head from a first material, the primary element having a face and an opposite rear surface. A cavity is then defined within a portion of the primary element that is of unitary construction. The cavity is positioned between the face and the rear surface, and at least a portion of the cavity extends substantially parallel to the face. The method also includes a step of positioning an insert element within the cavity, the insert element being formed of a second material that is different from the first material.

The advantages and features of novelty characterizing the present invention are pointed out with particularity in the appended claims. To gain an improved understanding of the advantages and features of novelty, however, reference may be made to the following descriptive matter and accompanying drawings that describe and illustrate various embodiments and concepts related to the invention.

DESCRIPTION OF THE DRAWINGS

The foregoing Summary of the Invention, as well as the following Detailed Description of the Invention, will be better understood when read in conjunction with the accompanying drawings.

DETAILED DESCRIPTION OF THE INVENTION

Figure 1:
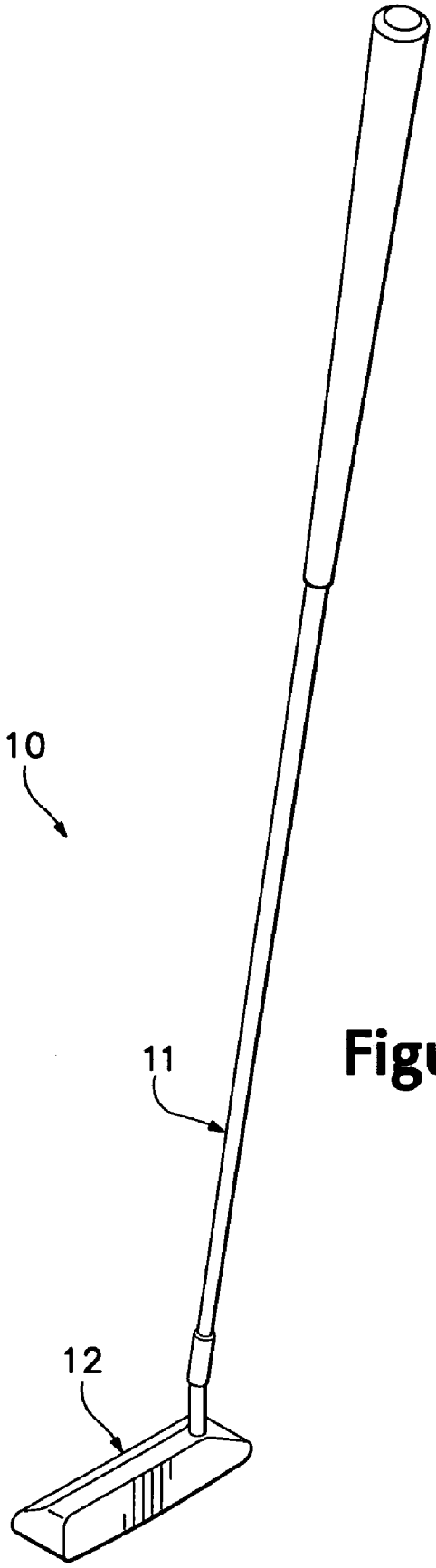
FIG. 1 is an elevational view of a golf club having a first head in accordance with the present invention.
Figure 2:
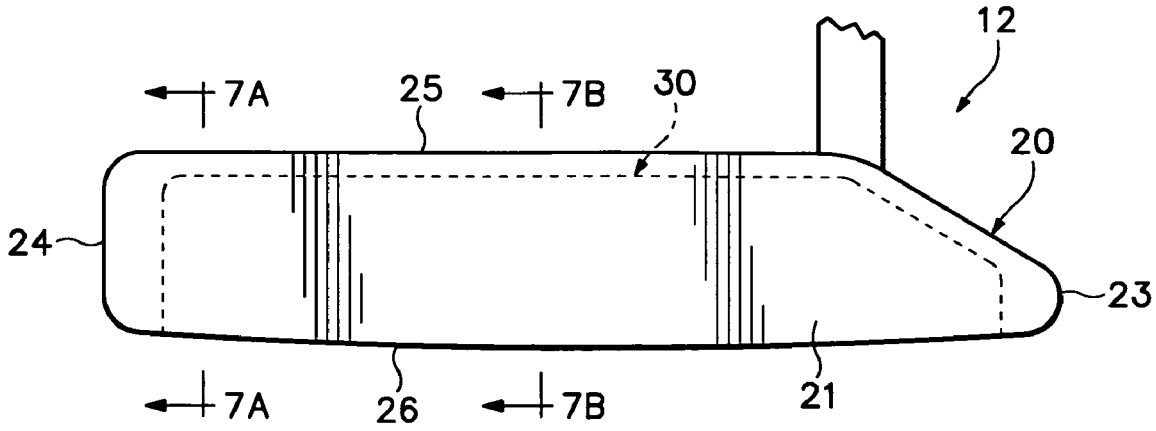
FIG. 2 is a front elevational view of the first head.
Figure 3:
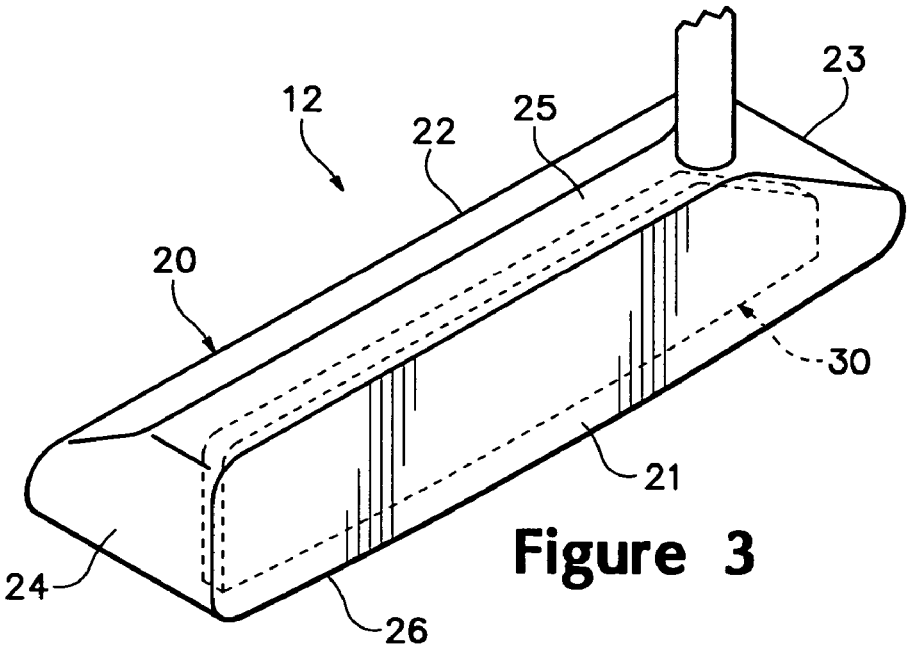
FIG. 3 is a perspective view of the first head.
Figure 4:
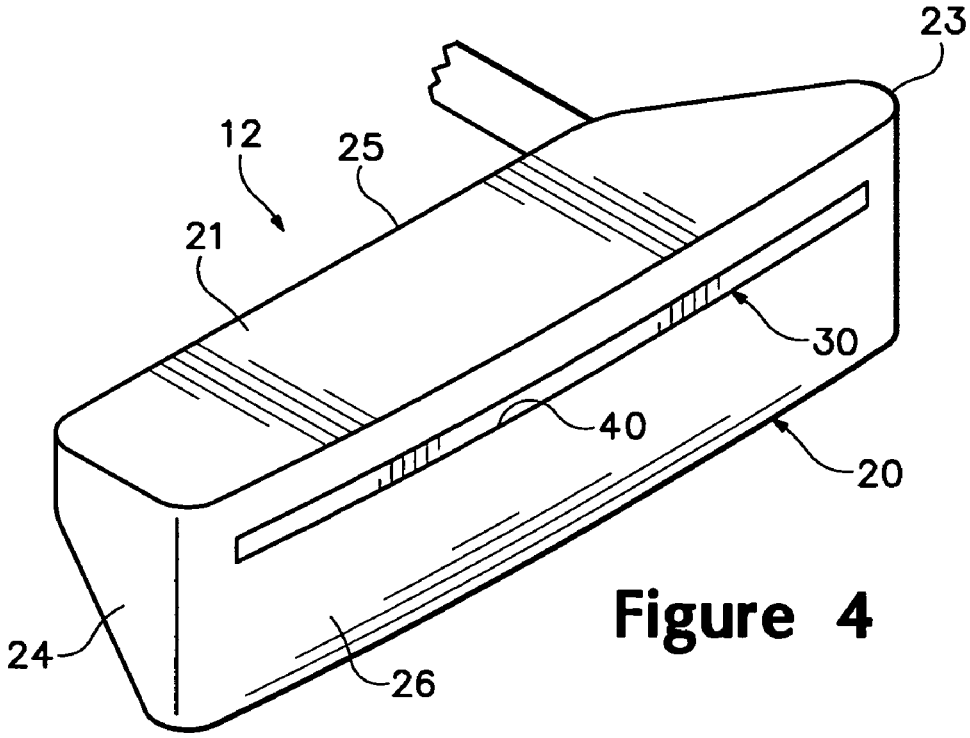
FIG. 4 is another perspective view of the first head.
Figure 5:
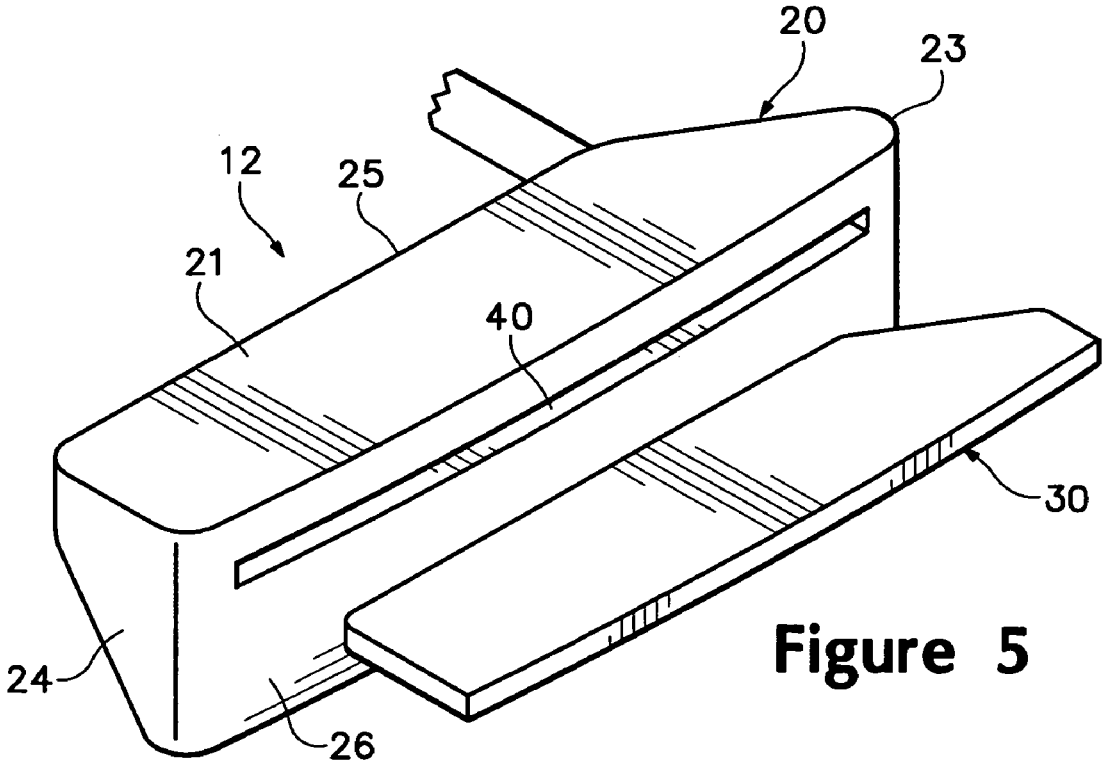
FIG. 5 is an exploded perspective view of the first head.
Figure 6:
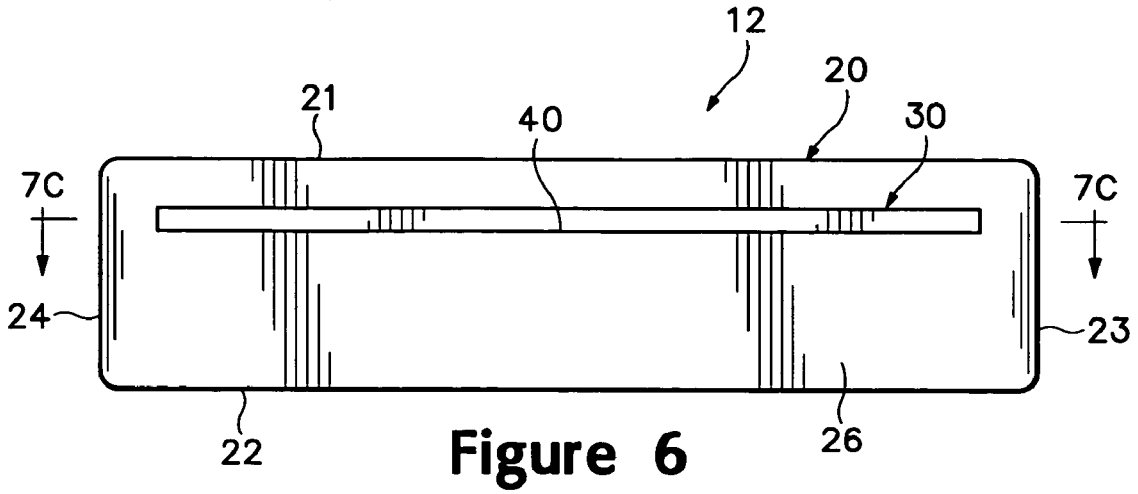
FIG. 6 is a bottom plan view of the first head.
Figure 7A:
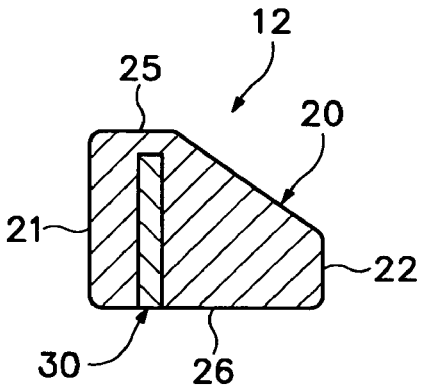
FIG. 7A is a first cross-sectional view of the first head, as defined by section line 7A—7A in FIG. 2.
Figure 7B:
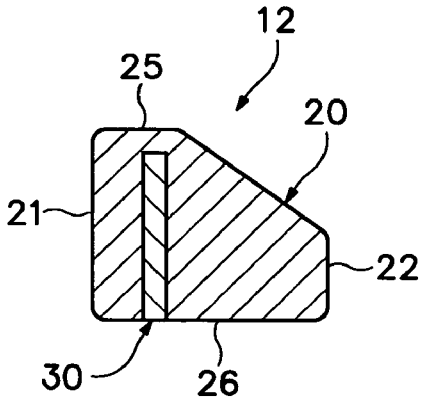
FIG. 7B is a second cross-sectional view of the first head, as defined by section line 7B—7B in FIG. 2.
Figure 7C:
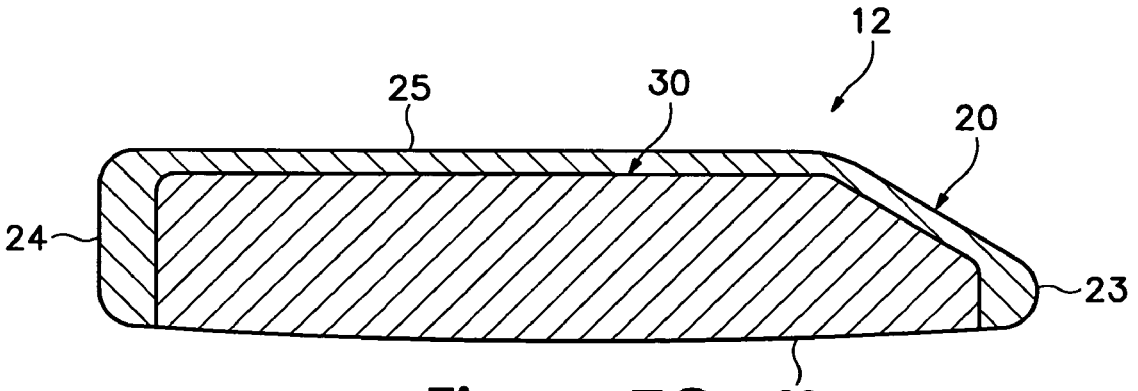
FIG. 7C is a third cross-sectional view of the first head, as defined by section line 7C—7C in FIG. 6.

The following discussion and accompanying figures disclose a golf club 10 in accordance with the present invention. Although concepts related to golf club 10 are disclosed with reference to the structure of a putter, the various concepts may also be applied to a variety of other golf club types, including drivers, woods, and irons. The primary elements of golf club 10 are a shaft 11 and a head 12, as depicted in FIG. 1. Shaft 11 has a generally elongate configuration and may be formed from a variety of conventional materials, including graphite or steel. A grip may extend over a first end of shaft 11 to provide a comfortable and slip-resistant area for grasping golf club 10. Head 12 is secured to an opposite second end of shaft 11 and is configured to engage a golf ball, thereby propelling the golf ball in an intended direction. As depicted in FIGS. 2–7C, head 12 includes a primary element 20 and an insert element 30.

Primary element 20 has the general shape and dimensions of a conventional golf club head and defines, therefore, a face 21 for engaging a golf ball. Face 21 is positioned opposite a rear surface 22 and exhibits a generally planar configuration that may have a textured surface for gripping or otherwise limiting the degree to which the golf ball slides against face 21. In operation, face 21 contacts the golf ball and propels the golf ball in the intended direction. In effect, therefore, the golf ball rebounds from face 21. Primary element 20 also defines a heel side 23 an opposite toe side 24. When an individual is utilizing golf club 10, heel side 23 is positioned adjacent to the feet of the individual, and toe side 24 faces away from the feet. In addition, primary element 20 includes an upper surface 25 and an opposite lower surface 26. Each of sides 23–24 and surfaces 25–26 extend between face 21 and rear surface 22.

In contrast with the conventional golf club head, primary element 20 defines a cavity 40 that receives insert element 30. Cavity 40 is formed within primary element 20 and positioned between face 21 and rear surface 22. Cavity 40 is oriented in a direction that extends between heel side 13 and toe side 14, thereby extending in a direction that is substantially parallel to face 21. As depicted in the bottom view of FIG. 6 and the cross-sections of FIGS. 7A–7C, cavity 40 exhibits a substantially rectangular configuration that has a constant thickness in the direction between face 21 and rear surface 22. As will be described in greater detail below, however, cavity 40 may have a variety of non-rectangular configurations.

A lower portion of cavity 40 extends through lower surface 26 to form an opening in primary element 20 and provide access to cavity 40. In further embodiments of the invention, access to cavity 40 may be provided by an opening that is formed in an alternate location, such as upper surface 25, heel side 23, or toe side 24. Depending upon the specific configuration of head 12, cavity 40 may also be formed wholly within primary portion 40 such that no exterior opening provides access to cavity 40.

The portion of primary element 20 that forms cavity 40 is of unitary (i.e., one-piece) construction. Accordingly, cavity 40 is formed from a one-piece portion of primary element 20. A variety of materials may be utilized to form primary element 20, including a variety of metals such as steel, iron, aluminum, titanium, tungsten, and various alloys. Primary element 20 may also be formed from two or more materials. For example, a majority of primary element 20 may be formed from stainless steel, and face 21 may be formed from aluminum. Portions of primary element 20 may also be formed from graphite, wood, or polymer materials. In addition, primary element 20 may be formed from a plurality of separate elements that are joined together. Although primary element 20 may be formed from a variety of materials, may include incorporate two different materials, or may be formed from a plurality of joined elements, cavity 40 is formed from a portion of primary element 20 that is of unitary construction.

By manufacturing the portion of primary element 20 that forms cavity 40 to exhibit a unitary construction, various advantages are gained over golf club heads without a similar unitary construction. For example, forming this portion of primary element 20 from a one-piece member enhances the durability of head 12 by minimizing the number of elements that are joined together. In addition, joining a lesser number of elements together permits head 12 to be manufactured with stricter design tolerances. Accordingly, manufacturing the portion of primary element 20 with unitary construction enhances the overall durability and quality of head 12.

A variety of manufacturing methods may be employed to form primary element 20 such that the portion defining cavity 40 is of unitary construction. For example, primary element 20 may be formed through a milling process that removes material from a larger material element, thereby effectively sculpting primary element 20 from the larger material element. In order to define cavity 40, material may be removed from the interior of primary element 40 during the milling process. As an alternative to milling, primary element 20 may be formed through a casting process, wherein a molten material is poured into a mold having the general shape of primary element 20. A protrusion having the shape of cavity 40 may be located within the mold in order to form cavity 40. A combination of the milling and casting processes may also be utilized to form primary element 20. For example, primary portion 20 may be cast in a manner that does not form cavity 40, and a milling process may be subsequently utilized to remove material and form cavity 40. In this manner, a conventional golf club head may be retrofitted to include an insert 30 that is positioned within a cavity 40. Primary element 20 may be entirely formed through the milling or casting processes discussed above. In some embodiments of the invention, however, only the portion of primary element 20 that forms cavity 40 is formed through a milling or casting process, thereby permitting other elements to be added to primary element 20. Based upon the above discussion, a variety of manufacturing methods are suitable for forming primary portion 20.

Insert element 30 exhibits the general configuration of cavity 40 and is positioned or otherwise secured within cavity 40. The material forming insert element 30 is generally dissimilar from the material forming primary element 20. Accordingly, insert element 30 forms an area of head 12 that exhibits different properties than primary element 20. As discussed in greater detail below, the difference in properties between primary element 20 and insert element 30 may be utilized, for example, to redistribute mass in head 12 and modify the vibrational characteristics of golf club 10.

Whereas primary element 20 may be formed from a metal material, for example, insert element 30 may be formed from a variety of polymer materials, such as nylon or polyurethane. A specific polymer material that is suitable for insert element 30 is a polyether block amide, such as PEBAX, which is manufactured by the Atofina Company. Polyether block amide provides a variety of characteristics that benefit the present invention, including high impact resistance at low temperatures, few property variations in the temperature range of minus 40 degrees Celsius to positive 80 degrees Celsius, resistance to degradation by a variety of chemicals, and low hysteresis during alternative flexure. Another suitable polymer material for reinforcing structure 40 is a polybutylene terephthalate, such as HYTREL, which is manufactured by E. I. duPont de Nemours and Company. In addition to the above materials, insert element 30 may be formed from graphite, wood, or a carbon or glass fiber reinforced polymer material. As discussed above, the material forming insert element 30 is generally different than the material forming primary element 20. Insert element 30 may be formed, therefore, from a metal material that is different from the metal material forming primary element 20.

The manufacturing process for insert element 30 may depend upon the specific material selected for insert element 30. When formed from graphite, wood, or reinforced polymer materials, for example, the manufacturing process may involve forming insert element 30 separate from primary element 20 and then positioning insert element 30 within cavity 40. When insert element 30 is formed from a polymer or metal material, the same manufacturing process may be utilized. As an alternative, however, a molten polymer or metal material may be directly poured into cavity 40 and permitted to cool, thereby forming insert element 30 through a single manufacturing step. Accordingly, a variety of processes may be utilized to form insert element 30.

Insert element 30 may be utilized to redistribute mass in head 12. The position of a center of gravity of head 12, otherwise referred to as the center of mass, has an influence upon whether the golf ball veers right, veers left, or follows a generally straight route. In general, the golf ball follows a straight route when the center of gravity is positioned behind the point of engagement on face 21. When the center of gravity is spaced to one side of the point of engagement, however, the golf ball may follow a veering route. The degree to which the golf ball veers left or right depends, for example, upon the specific position of the center of gravity. More particularly, the degree to which the golf ball veers left or right depends upon the distance between face 21 and the position of the center of gravity. If the distance between face 21 and the position of the center of gravity is relatively small, the golf ball is more likely to veer left or right. If the distance between face 21 and the position of the center of gravity is relatively large, however, the golf ball is more likely to follow a generally straight route. Accordingly, a redistribution of the mass of head 12 that positions the center of gravity further from face 21 may be utilized to increase the accuracy of golf club 10.

The center of gravity of head 12 is defined as an equilibrium point. More specifically, the center of gravity of head 12 is a point at which the entire weight of head 12 may be considered as concentrated so that, if supported at that point, head 12 would remain in static equilibrium in any position. Head 12 is a combination of two elements, namely primary element 20 and insert element 30. The position of the center of gravity of head 12 is, therefore, dependent upon the properties of primary element 20 and insert element 30. That is, the position of the center of gravity of head 12 is influenced by the relative masses and positions of primary element 20 and insert element 30. Whereas primary element 20 may be formed from a relatively dense metal material, insert element 30 may be formed from a polymer material of lesser density. Given the proximity of insert element 30 to face 21, the lesser density of insert element 30 operates to redistribute the center of gravity of head 12 closer to rear surface 22. Accordingly, the presence of insert element 30 positions the center of gravity further from face 21, thereby increasing the accuracy of golf club 10.

Insert element 30 may also be utilized to modify the vibrational characteristics of golf club 10. Following impact with the golf ball, golf club 10 may have a tendency to vibrate. The degree of vibration exhibited by golf club 10 is moderated, however, by insert element 30. As discussed above, primary element 20 and insert element 30 are formed of materials with different properties. For example, insert element 30 may be formed of a polymer material that is positioned within the metal material forming primary element 20. Differences in the properties of the materials forming primary element 20 and insert element 30 may provide a damping effect, thereby limiting the degree of vibration in golf club 10.

Figure 8:
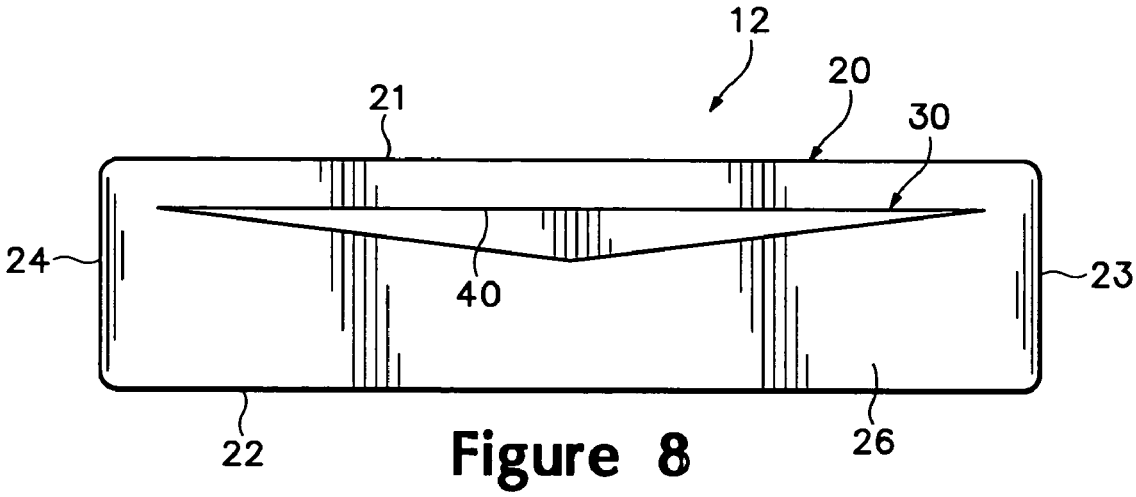
FIG. 8 is a bottom plan view of a second head in accordance with the present invention.
Figure 9:
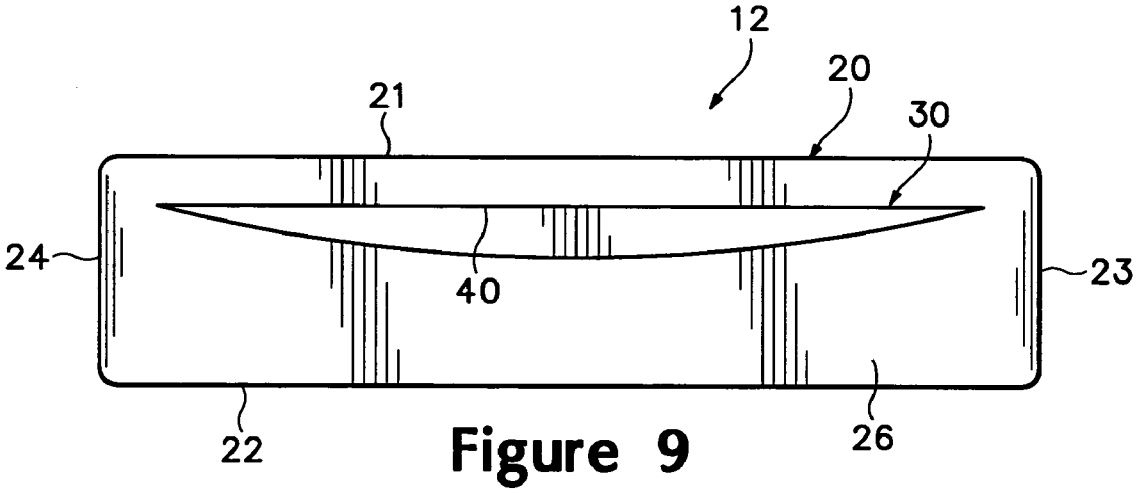
FIG. 9 is a bottom plan view of a third head in accordance with the present invention.
Figure 10:
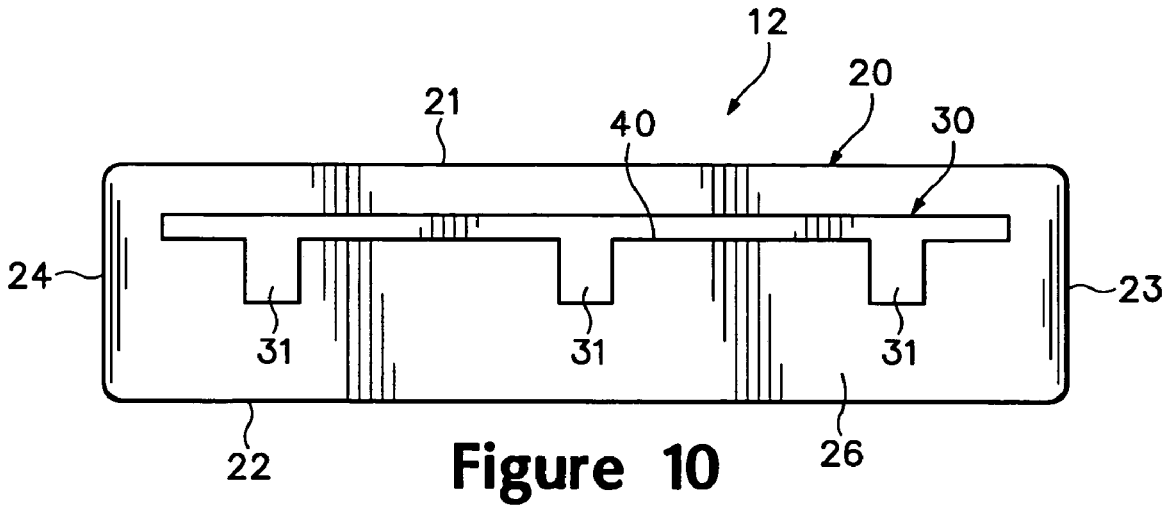
FIG. 10 is a bottom plan view of a fourth head in accordance with the present invention.
Figure 11:
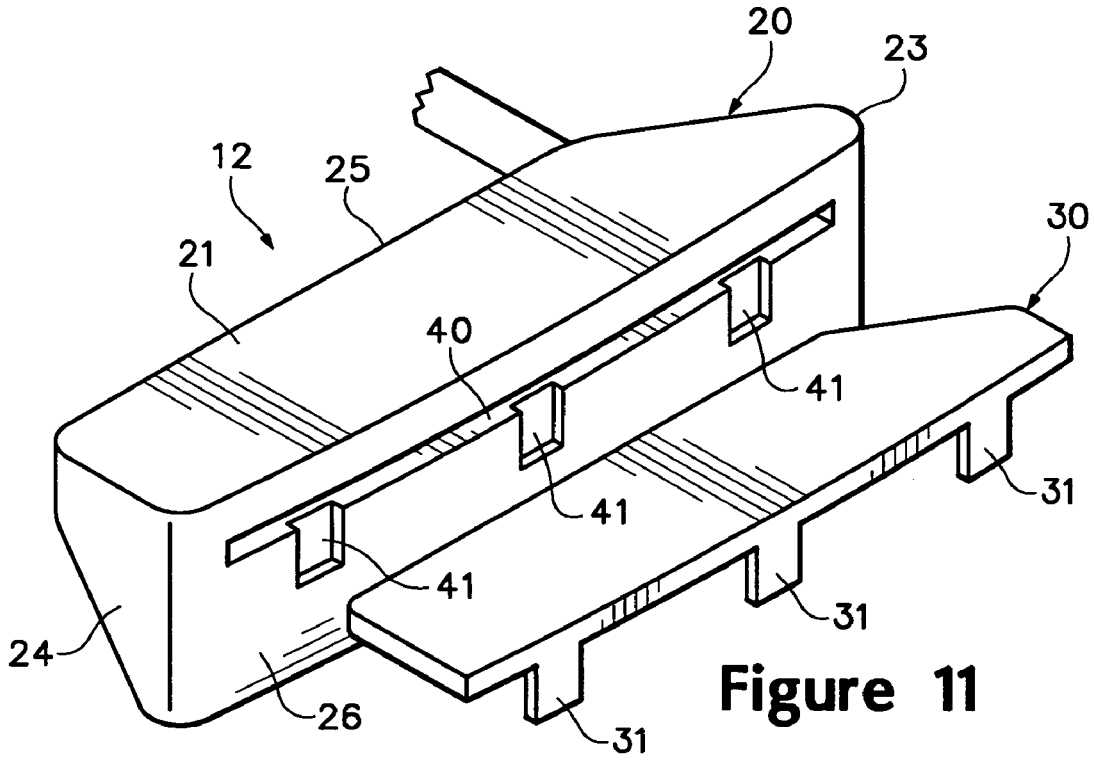
FIG. 11 is an exploded perspective view of the fourth head.

The configuration of golf club 10, as described above and depicted in FIGS. 1–7C, is intended to provide an example of a suitable golf club within the scope of the present invention. As discussed in the above material, cavity 40 exhibits a substantially rectangular configuration that has a constant thickness in the direction between face 21 and rear surface 22, but may also have a variety of non-rectangular configurations. With reference to FIG. 8, primary element 20 is depicted as forming cavity 40 with a generally triangular configuration, and insert element 30 exhibits a corresponding shape. The thickness of insert element 30 may, therefore, decreasingly-taper toward end portions of cavity 40. A similar modification is depicted in FIG. 9, wherein cavity 40 and insert element 30 exhibit a curved configuration. Referring to FIGS. 10 and 11, three depressions 41 extend rearward from cavity 40, and insert element 30 includes three tab elements 31 that are received by depressions 41. Accordingly, cavity 40 and insert element 30 may exhibit a varying thickness, a non-planar shape, or a variety of configurations within the scope of the present invention.

Figure 12:
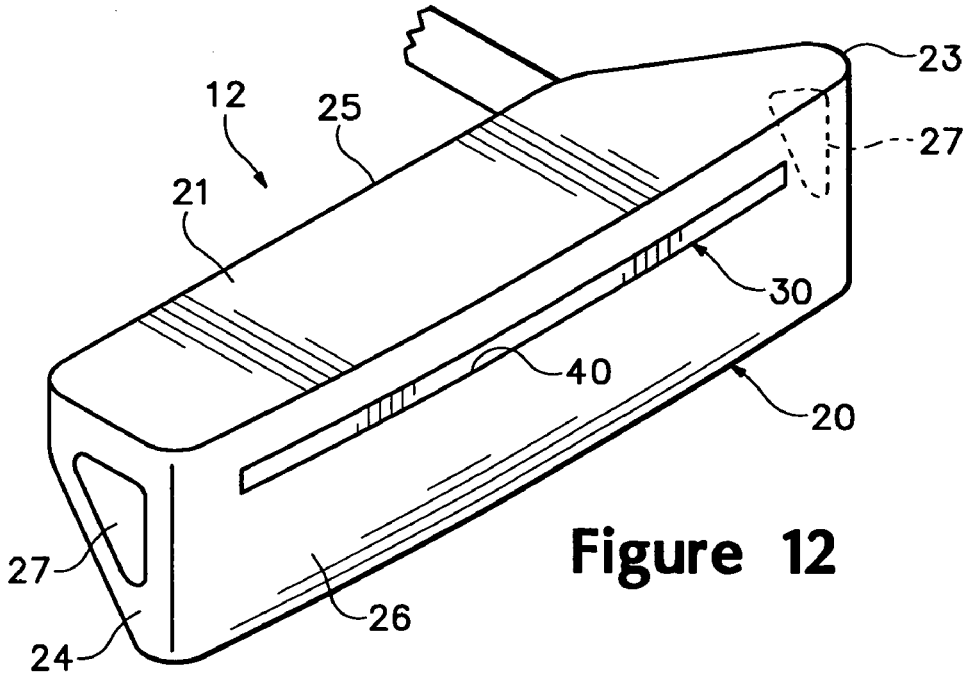
FIG. 12 is a perspective view of a fifth head in accordance with the present invention.
Figure 13:
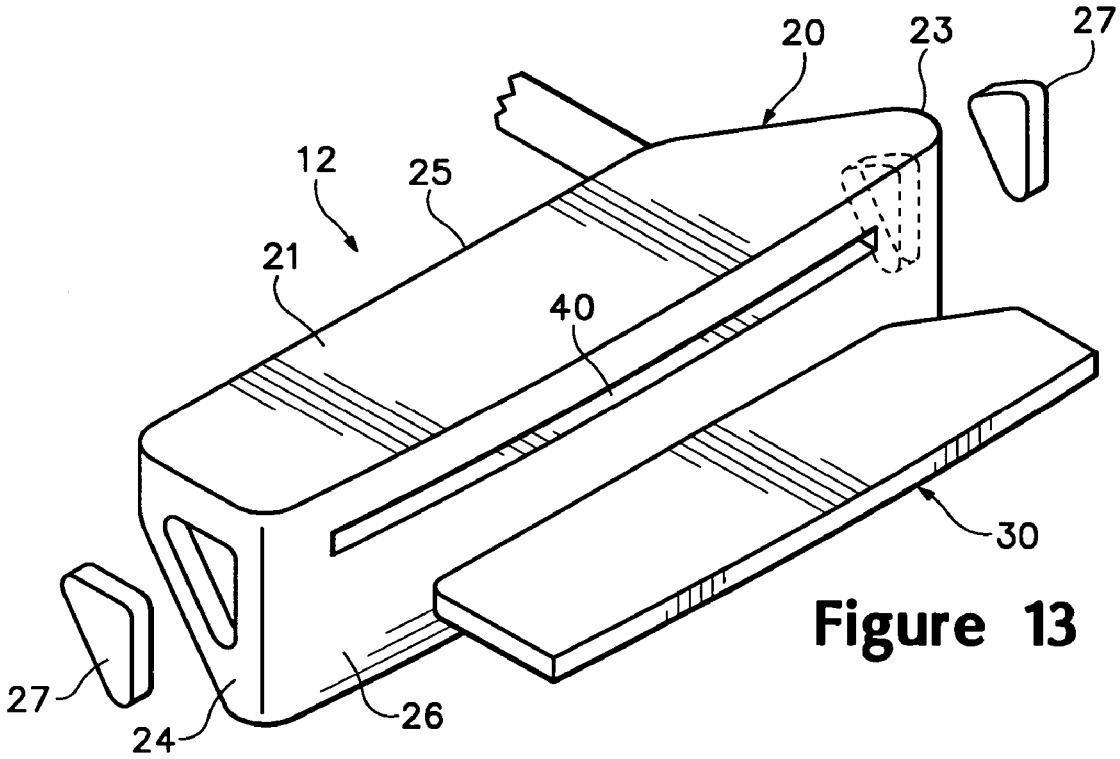
FIG. 13 is an exploded perspective view of the fifth head.
Figure 14:
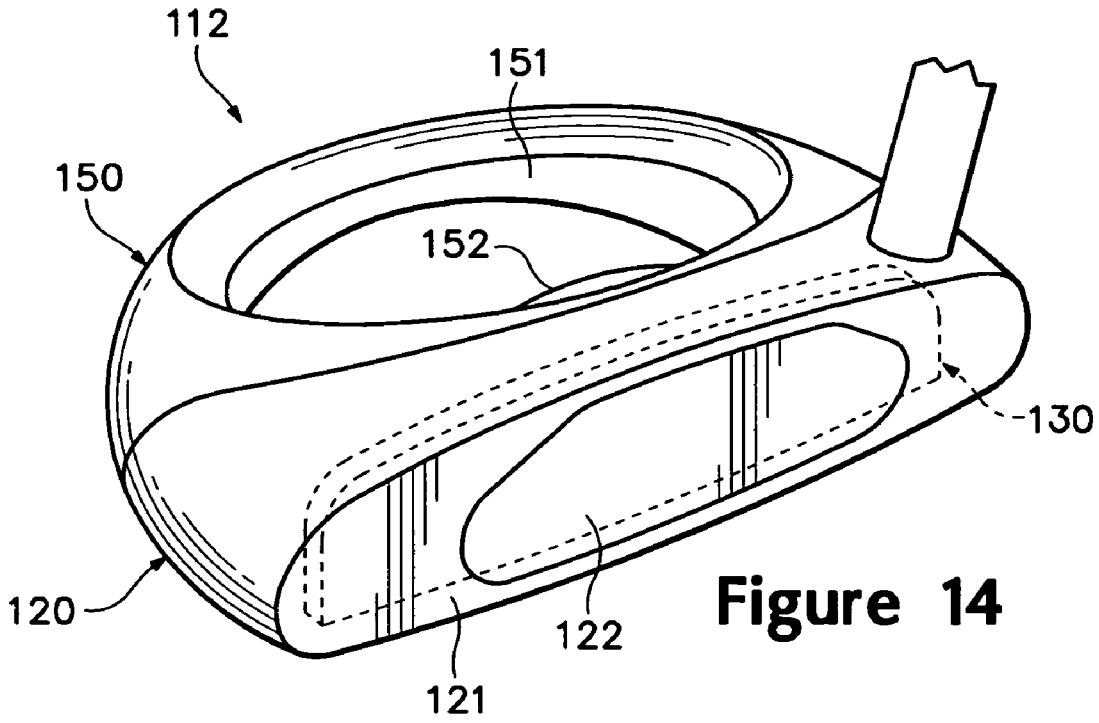
FIG. 14 is a perspective view of a sixth head.
Figure 15:
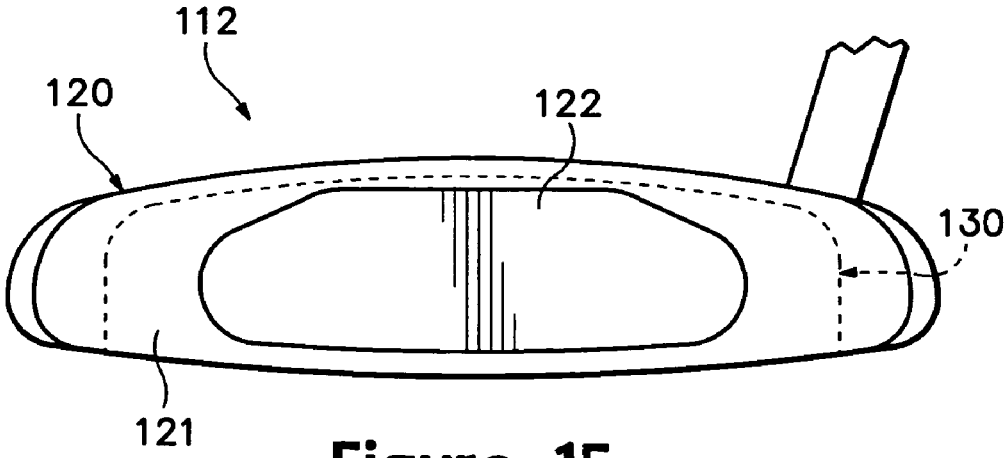
FIG. 15 is a front elevational view of the sixth head.
Figure 16:
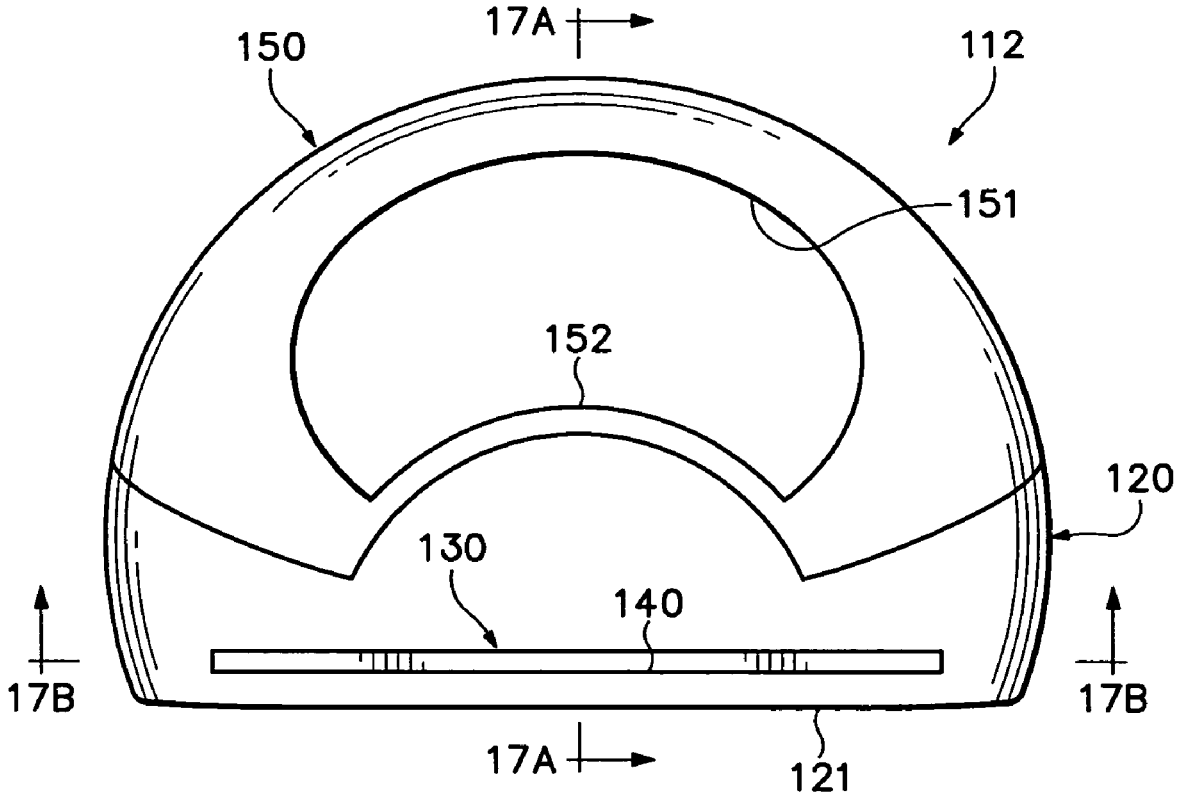
FIG. 16 is a bottom plan view of the sixth head.
Figure 17A:
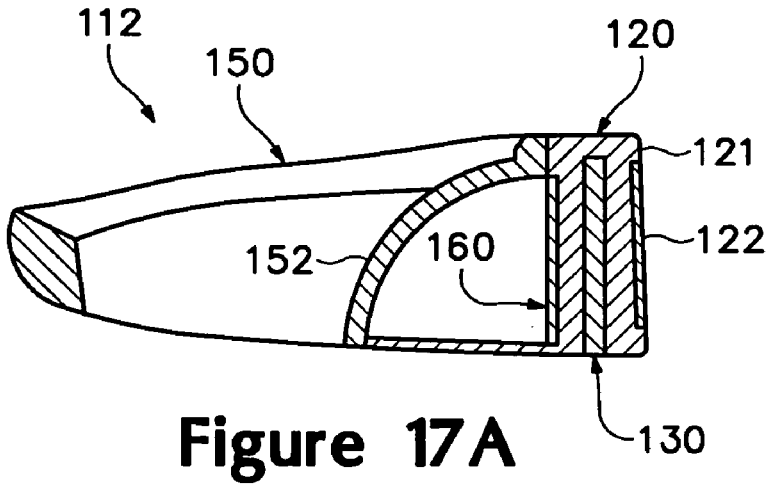
FIG. 17A is a first cross-sectional view of the sixth head, as defined by section line 17A—17A in FIG. 16.
Figure 17B:
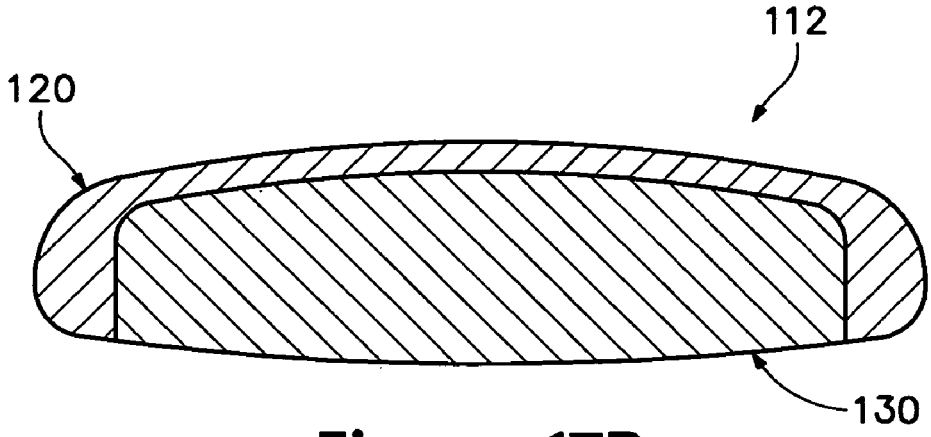
FIG. 17B is a second cross-sectional view of the sixth head, as defined by section line 17B—17B in FIG. 16.
Figure 18:
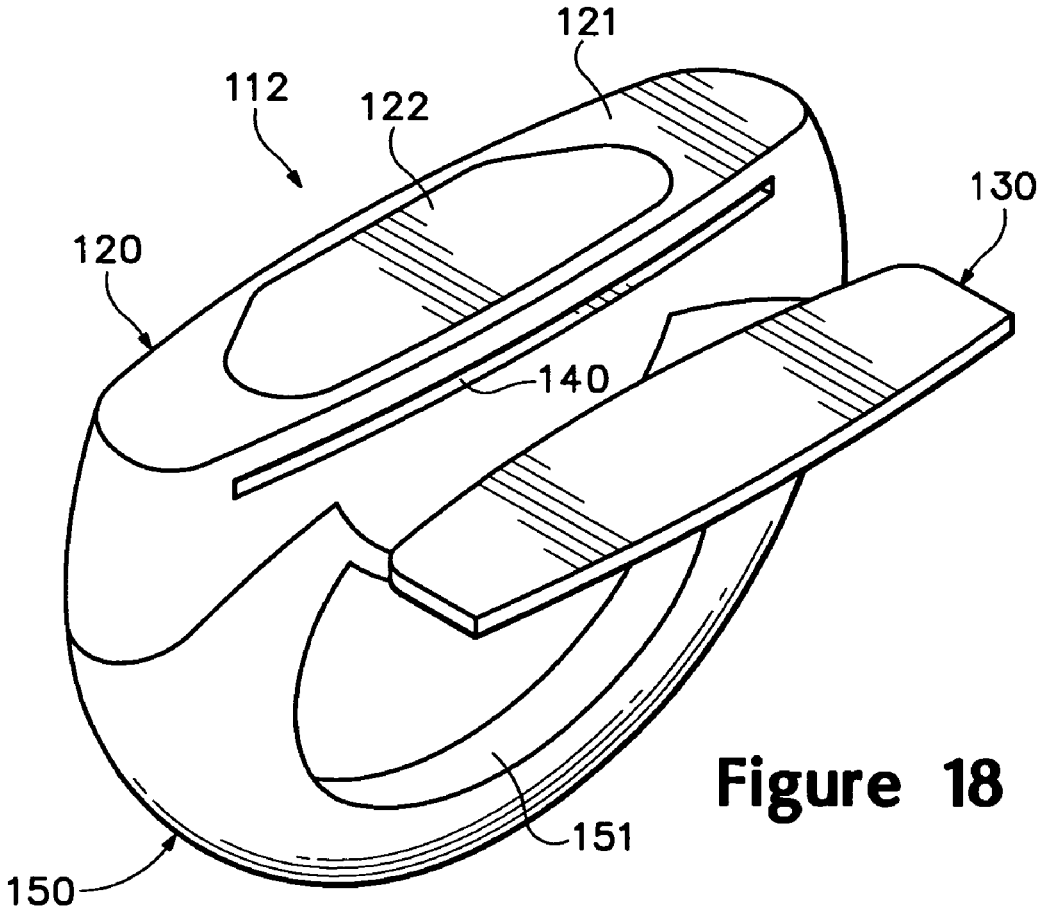
FIG. 18 is an exploded perspective view of the sixth head.

Primary element 20 may exhibit dimensions that are substantially similar to the dimensions of a conventional golf club head, and primary element 20 may be formed of materials that are substantially similar to the materials of the conventional golf club head. Despite the presence of insert element 30, the overall mass of head 12 may be decreased in comparison with a head of the conventional golf club. In order to provide additional mass to primary element 20, thereby equating the mass of head 12 with the mass of the conventional golf club head, additional elements 27 may be secured within depressions in primary element 20, as depicted in FIGS. 12 and 13. Elements 27 may be formed of a relatively dense material, such as tungsten, that accounts for the decreased mass of head 12 due to the removal of the material from cavity 40.

Elements 27 are depicted as being secured to each of heel side 23 and toe side 24. A benefit to this configuration is an increase in the moment of inertia of head 12. When the moment of inertia of a golf club head is relatively large, the golf club head resists rotating upon contact with the golf ball and the golf ball follows a generally straight route. In circumstances where the golf club head rotates, however, the golf ball may follow a route that veers left or right. Placing elements 27 on each of heel side 23 and toe side 24 operates to distribute the mass of head 12 in peripheral portions of head 12, thereby increasing the moment of inertia.

Another head 112 is depicted in FIGS. 14–18 and includes a primary element 120, an insert element 130, a cavity 140, and a ring element 150. Head 112 may also include a plate 160 that is positioned between primary element 120 and ring element 150. Primary element 120 is positioned in a front area of head 112 and defines a generally planar face 121 that includes a chip 122 for engaging a golf ball, with chip 122 being recessed into face 121. In addition, an aperture or concavity may be formed in primary element 120 to receive the end of a shaft and secure head 112 to the shaft. Ring element 150 is positioned in a rearward area of head 112 and is positioned substantially rearward of primary element 120. Ring element 150 has the general configuration of a ring structure that defines an aperture 151, which has a generally elliptical shape, but may also be round, square, triangular, or rectangular within the scope of the present invention. In addition, aperture 151 may have a plurality of other geometric or non-geometric shapes. A protrusion 152 extends into aperture 151 and is depicted as being quarter-spherical in shape, but may have a variety of shapes within the scope of the present invention.

Cavity 140 is formed within primary element 120 and positioned between face 121 and ring element 150. Cavity 140 is oriented to extend in a direction that is substantially parallel to face 121. As depicted in the bottom view of FIG. 16 and the cross-sections of FIGS. 17A and 17B, cavity 140 exhibits a substantially rectangular configuration that has a constant thickness in the direction between face 121 and ring element 150, but may also have a variety of non-rectangular configurations. A lower portion of cavity 140 extends through a lower surface of primary element 120 to form an opening in primary element 120 and provide access to cavity 140. In further embodiments of the invention, access to cavity 140 may be provided by an opening that is formed in an alternate location, or cavity 140 may be formed wholly within primary element 120 such that no exterior opening provide access of cavity 140.

As with primary element 20, the portion of primary element 120 that forms cavity 140 is of unitary (i.e., one-piece) construction. Accordingly, cavity 140 is formed from a one-piece portion of primary element 120. The materials discussed above with respect to primary element 20 may be utilized to form primary element 120. Furthermore, primary element 120 may be formed from a variety of materials, may incorporate two different materials, or may be formed from a plurality of joined elements. A variety of materials may also be utilized to form ring element 150. As will be discussed below, however, benefits may be gained by forming primary element 120 from a relatively light material and forming ring element 150 from a relatively heavy material. As an example, therefore, primary element 120 may be formed from aluminum and ring element 150 may be formed from steel. In addition to metal materials, one or both of primary element 120 and ring element 150 may be formed from polymer materials or wood, for example.

Head 112 is designed such that the center of gravity is positioned relatively far from face 121. One attribute of head 112 that positions the center of gravity relatively far from face 121 is the presence of ring element 150. More particularly, ring element 150 extends in the rearward direction, and the mass of ring element 150 that is positioned in rearward areas of head 112 operates to shift the center of gravity in the rearward direction. As discussed above, primary element 120 may be formed from aluminum and ring element 150 may be formed from steel. Aluminum is substantially less dense than steel and has, therefore, less mass per unit volume. By forming forward areas of head 112 from aluminum and rearward areas of head 112 from steel, the majority of the mass is concentrated in rearward portions of head 112. Accordingly, the configuration of head 112 and the different materials utilized for primary element 120 and ring element 150 position the center of gravity in a spaced relationship with respect to face 121.

Another feature of head 112 that affects the position of the center of gravity is the presence of insert element 130. The position of the center of gravity of head 112 is influenced by the relative masses and positions of insert element 130 and the remainder of head 112. Whereas primary element 120 and ring element 140 may be formed from a metal material, insert element 130 may be formed from a polymer material of lesser density. Given the proximity of insert element 130 to face 121, the lesser density of insert element 130 operates to shift the position of the center of gravity of head 112 rearward. Accordingly, the presence of insert element 130 positions the center of gravity further from face 121, thereby increasing the accuracy of golf club 10.

Insert element 130 may also be utilized to modify the vibrational characteristics of the golf club. Following impact with the golf ball, the degree of vibration exhibited by the golf club may be moderated by insert element 130. As discussed above, primary element 120 and insert element 130 are formed of materials with different properties. Differences in the properties of the materials forming primary element 120 and insert element 130 may provide a damping effect, thereby limiting the degree of vibration in the golf club.

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

That which is claimed is:

1. A golf club having a shaft and a head secured to the shaft, the head comprising:

a primary element at least partially formed of a first material, the primary element defining a first surface and an opposite second surface, the first surface providing an area for engaging a golf ball, and substantially all of the first surface being formed from the first material;

a cavity defined by a portion of the primary element that is of unitary construction, the cavity being positioned between the first surface and the second surface, at least a portion of the cavity extending in a direction that is substantially parallel to the first surface;

at least one depression that is defined by the primary element and extends toward the second surface front the cavity; and an insert element formed of a second material and positioned within the cavity, the insert element including at least one protrusion extending into the depression, and the second material being different than the first material, the second material having a lesser density than the first material.

2. The golf club recited in claim 1, wherein the cavity and the insert element exhibit a substantially constant thickness in a direction extending between the first surface and the second surface.

3. The golf club recited in claim 1, wherein the cavity extends through one of a lower surface and an upper surface of the primary element to expose the insert element.

4. The golf club recited in claim 3, wherein the at least one depression is formed in the one of the lower surface and the upper surface.

5. The golf club recited in claim 1, wherein the first material is a metal and the second material is a polymer.

6. The golf club recited in claim 1, wherein dimensions of the insert element are substantially similar to dimensions of the cavity.

7. A golf club having a shaft and a head secured to the shaft, the head comprising:

a primary element formed of a metal material, the primary element defining a face and an opposite rear surface;

a cavity defined by a portion of the primary element that is of unitary construction, the cavity being positioned between the face and the rear surface, and the cavity forming an opening in a lower surface of the primary element and extending only partially between the lower surface and an upper surface of the primary element, the cavity having a substantially constant thickness, the cavity extending in a direction between a heel side end a toe side of the head, and the cavity having at least one depression formed in the lower surface and extending toward the rear surface; and an insert element formed of a polymer material with a lesser density than the metal material, the insert element being positioned within the cavity, and a portion of the insert element being located within the at least one depression.

8. The golf club recited in claim 7, wherein at least a portion of the cavity extends in a direction that is substantially parallel to the face.

9. The golf club recited in claim 7, wherein the metal material is steel.

10. The golf club recited in claim 7, wherein dimensions of the inset element are substantially similar to dimensions of the cavity.

11. A method of manufacturing a head for a golf club, the method comprising steps of:

forming a primary element of the head from a first material by casting the primary element with a mold, the primary element having a face and an opposite rear surface;

defining a cavity within a portion of the primary element that is of unitary construction by positioning a protrusion in the mold that forms the cavity, the cavity being positioned between the face and the rear surface, at least a portion of the cavity extending substantially parallel to the face, and the cavity including at least one depression extending toward the rear surface; and positioning an insert element within the cavity, the insert element being formed of a second material that is different from the first material.

12. The method recited in claim 11, wherein the step of forming includes milling the primary element.

13. The method recited in claim 11, wherein the step of positioning includes molding an insert element by introducing the second material in a molten state into the cavity.

* * * * *

UNITED STATES PATENT AND TRADEMARK OFFICE

CERTIFICATE OF CORRECTION

PATENT NO. : 7,134,971 B2
APPLICATION NO. : 10/774696
DATED : November 14, 2006
INVENTOR(S) : David N. Franklin et al.

It is certified that error appears in the above-identified patent and that said Letters Patent is hereby corrected as shown below:

Column 8, line 39, change “front” to -- from --.

Signed and Sealed this

Ninth Day of January, 2007

JON W. DUDAS
*Director of the United States Patent and Trademark Office*